US005713252A

United States Patent [19]

Iwinski et al.

[11] Patent Number: 5,713,252

[45] Date of Patent: Feb. 3, 1998

[54] ERGONOMIC MULTI-TOOL HANDLE

[75] Inventors: Dean J. Iwinski, Muskego; Mark J. Hasenberg, Kenosha, both of Wis.

[73] Assignee: Snap-on Technologies, Inc., Lincolnshire, Ill.

[21] Appl. No.: 616,622

[22] Filed: Mar. 15, 1996

[51] Int. Cl.[6] ..... B25B 23/00

[52] U.S. Cl. ..... 81/439; 81/177.1; 81/125.1

[58] Field of Search ..... 81/437–439, 177.1, 81/125.1, 124.4, 57.5, 489

[56] References Cited

U.S. PATENT DOCUMENTS

| | | | |
|---|---|---|---|
| D. 180,643 | 7/1957 | Fitch . | |
| 190,119 | 5/1877 | Budd . | |
| D. 326,036 | 5/1992 | Anderson . | |
| D. 344,664 | 3/1994 | Malkinson . | |
| 1,168,185 | 1/1916 | Fleck . | |
| 1,360,121 | 11/1920 | Lawrence . | |
| 1,620,262 | 3/1927 | Klaboe . | |
| 3,191,649 | 6/1965 | Dzus | 81/439 |
| 3,742,533 | 7/1973 | Brunette . | |
| 3,850,056 | 11/1974 | Allen . | |
| 4,003,418 | 1/1977 | Andersson . | |
| 4,640,155 | 2/1987 | Condon . | |
| 4,899,409 | 2/1990 | Cox, Jr. . | |
| 4,926,721 | 5/1990 | Hsaio | 81/439 X |
| 5,186,083 | 2/1993 | Hsaio . | |
| 5,365,811 | 11/1994 | Chi . | |

FOREIGN PATENT DOCUMENTS

| | | | |
|---|---|---|---|
| 353322 | 7/1931 | United Kingdom | 81/439 |

*Primary Examiner*—D. S. Meislin

*Attorney, Agent, or Firm*—Emrich & Dithmar

[57] ABSTRACT

A hand tool is provided having a handle which includes a generally triangular body having first, second and third vertices and first, second and third sides and is adapted to fit readily in the hand of a user. The handle also includes three tubular tool holding arms for respectively holding three tool units. The tool holding arms project laterally outwardly from the sides and are spaced from adjacent vertices. In one embodiment, the tool units have L-shaped attachment portions enclosed in the handle body. In another embodiment, the tool units are socketed in a hub around which the handle is molded.

17 Claims, 3 Drawing Sheets

ERGONOMIC MULTI-TOOL HANDLE

BACKGROUND OF THE INVENTION

1. Field of the Invention

This invention relates to multi-purpose or multiple size manual tools, and more particularly to ergonomic handles for such tools.

2. Description of the Prior Art

Multi-purpose or multiple size tools, such as three-way hex wrenches, have previously been provided. These tools typically include three hex wrenches connected to a Y-shaped handle with the work-engaging portion of each hex wrench projecting outwardly from the handle in the direction of one of the lines of the Y-shaped hub.

Some of these tools suffer because the handles have flat planar faces and sharp corners which pinch into a user's fingers and cause discomfort. Others of these tools have handles with small volumes that lie substantially only between a user's fingers in use. This may cause discomfort and not allow the user to employ most of the muscles of his hand to exert torque to a fastener or the like.

SUMMARY OF THE INVENTION

It is a general object of the invention to provide an improved multiple-tool handle which avoids the disadvantages of prior tool handles while affording additional structural and operational advantages.

An important feature of the invention is the provision of a tool handle which is of relatively simple and economical construction.

A still further feature of the present invention is the provision of a tool handle which is ergonomically shaped to fit comfortably in a user's hand and which allows the user to easily exert torque to an item engaged with one of the tool units connected to the handle.

Yet another feature of the invention is the provision of a multiple-way tool incorporating a handle of the type set forth.

These and other features of the invention are attained by providing a handle for tools. The handle includes a generally triangular body having first, second and third vertices and first, second and third sides and adapted to fit readily in the hand of a user. The handle also includes a first tubular tool holding arm for holding a first tool unit. The first tool holding arm projects laterally outwardly from the first side and is spaced from adjacent vertices.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should readily understood and appreciated.

DETAILED DESCRIPTION OF THE PREFERRED EMBODIMENTS

Referring to FIGS. 1–6, a three-way tool 20 is illustrated. The tool 20 includes a one-piece molded handle 22 preferably made of a hard plastic. The handle 22 has a body 24 that is generally triangular in shape and has three equal-length sides 26A–C three vertices 28A–C.

The handle 22 also includes three tubular tool holding arms 30A–C, each having a generally frustoconical-shaped outer surface and respectively projecting laterally outwardly from substantially the centers of the three sides 26A–C and spaced from adjacent ones of the vertices 28A–C, so that the arms 30A–C are spaced substantially 120 degrees apart. As discussed further below, the tool holding arms 30A–C respectively divide the sides 26A–C into pairs of side portions 31A–32A, 31B–32B and 31C–32C. The arms 30A–C are, respectively, joined to the adjacent side portions 31A–C, 32A–C by pairs of concave finger engaging portions 33A–C.

Figure 1:
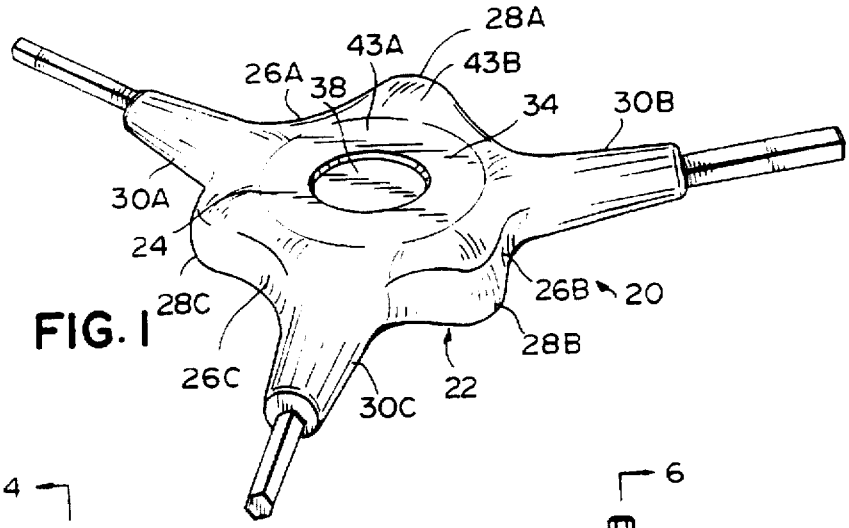
FIG. 1. is a perspective of the three-way tool of the present invention.
Figure 2:
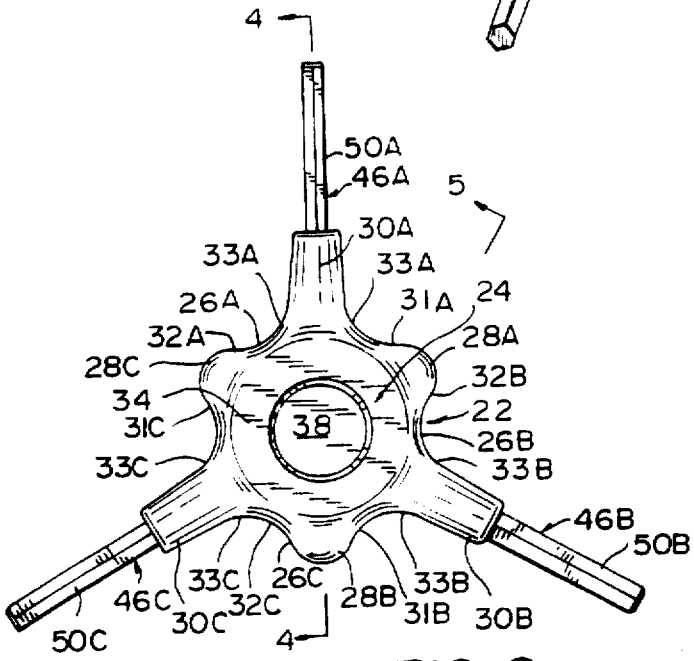
FIG. 2 is a reduced, top plan view of the tool of FIG. 1.
Figure 3:
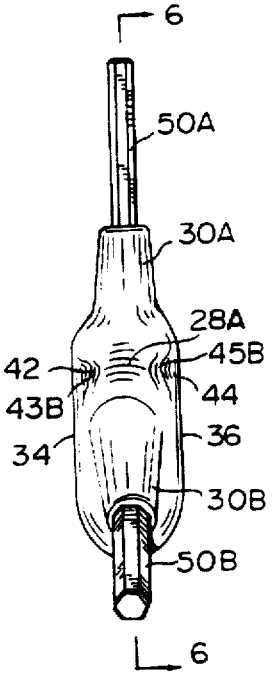
FIG. 3 is a side elevational view of the tool of FIG. 2.
Figure 4:
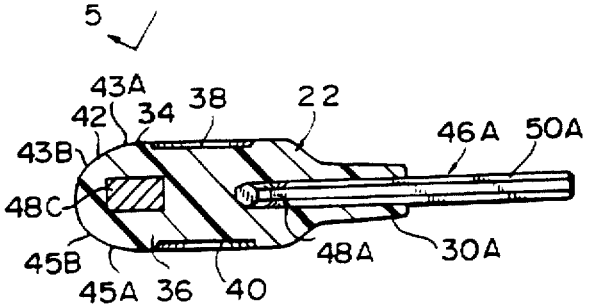
FIG. 4 is a sectional view taken generally along the line 4—4 of FIG. 2.
Figure 5:
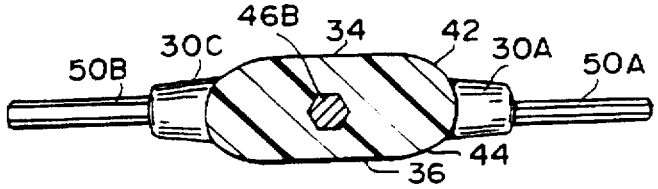
FIG. 5 is a sectional view taken generally along the line 5—5 of FIG.
Figure 6:
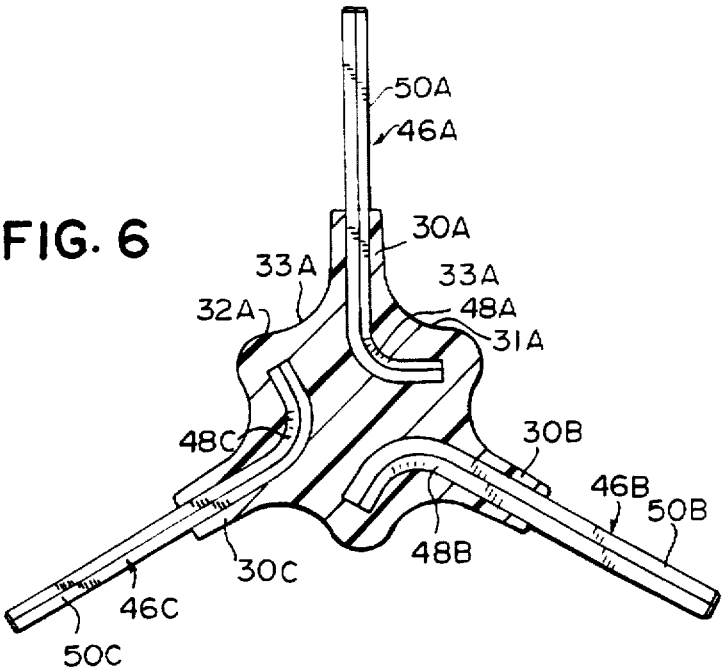
FIG. 6 is a sectional view taken generally along the line 6—6 of FIG. 3.

As seen best in FIG. 6, the tool 20 includes first, second and third L-shaped hex wrenches 46A–C, about portions of which the handle 22 is molded.

The handle 22 also includes first and second faces 34, 36 each disposed between and connecting the sides 26A–C. The faces 34, 36 are substantially mirror images of each other and respectively have axially aligned first and second circular recesses 38, 40. The faces 34, 36 respectively have annular outer convex surface portions 42, 44 disposed between the recesses 38, 40 and the sides 26A–C. As best seed in FIGS. 1, 3 and 4, each outer convex portions 42, 44 preferably may respectively have an inner convex surface portion 43A, 45A having a first radius and an outer convex surface portion 43B, 45B having a smaller second radius. The distance between the first and second faces 34, 36 thereby decreases from the outer periphery of the recesses 38, 40 to the sides 26A–C. The convex surface portions 42, 44 allow the handle 22 to fit comfortably in a user's hand.

The three hex wenches 46A–C respectively have L-shaped attachment portions 48A–C, respectively extending within the tool holding arms 30A–C and into the body 24. The hex wenches 46A–C also respectively include straight engagement portions 50A–C respectively disposed outside the tool holding arms 30A–C. The hex wrenches 46A–C are each of a different size so they can advantageously engage three different size hex sockets. The attachment portions 48A–C are L-shaped to prevent the engagement portions 50A–C from rotating relative to the handle 22 when each is engaged with and applying torque to an associated workpiece, such as a hex fastener.

The three-way tool 20 may be used as follows: First, the correct hex wrench is chosen, for example, hex wrench 46A. A user then places the body 24 into the palm of his hand with one of the faces, for example face 34, facing the palm. The user then places two fingers, such as the index and middle fingers, respectively on diametrically opposite sides of the tool holding arm 30A to respectively engage side portions 31A, 32A and into finger engaging portions 33A. The user then substantially forms a fist with his hand so that a portion of the user's fingers lie over the second face 36 of the handle 22 and the user's thumb lies over these finger portions. This allows the user to have the majority of the body 24 in the palm of his hand and is believed to allow the user to utilize his entire hand to apply torque with the tool 10.

Additionally, since the user's fingers only contact the tool holding arm 30A–C and not the hex wrenches 46A–C, a user's fingers will not be injured or have pressure applied thereto by the sharp corners of the hex wrenches 46A–C.

Figure 7:
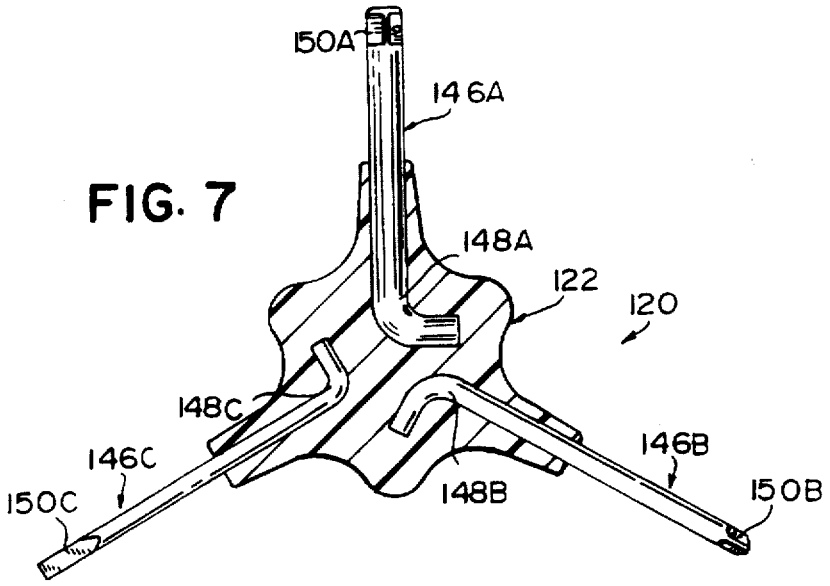
FIG. 7 is a view similar to FIG. 6, illustrating a second tool embodiment of the present invention having three different types of tool units.

Though the only type of tool unit shown in the tool 20 of FIGS. 1–6 are hex wrenches 46A–C, almost any type of tool unit may be used with the handle 22 of the present invention. For example, as seen in FIG. 7, a multi-purpose three-way tool 120 having a handle 122 substantially identical to the handle 22 of FIGS. 1–6 is illustrated. The tool 120 includes three different function tool units 146A–C, respectively having L-shaped attachment ends 148A–C about which the handle 122 is molded. Tool unit 146A includes a square drive (for a socket) engaging portion 150A, tool unit 146B has a Phillips-type engaging portion for driving Phillips-head fasteners and tool unit 146C has a flat screwdriver blade engaging portion for driving slot-head fasteners.

Figure 8:
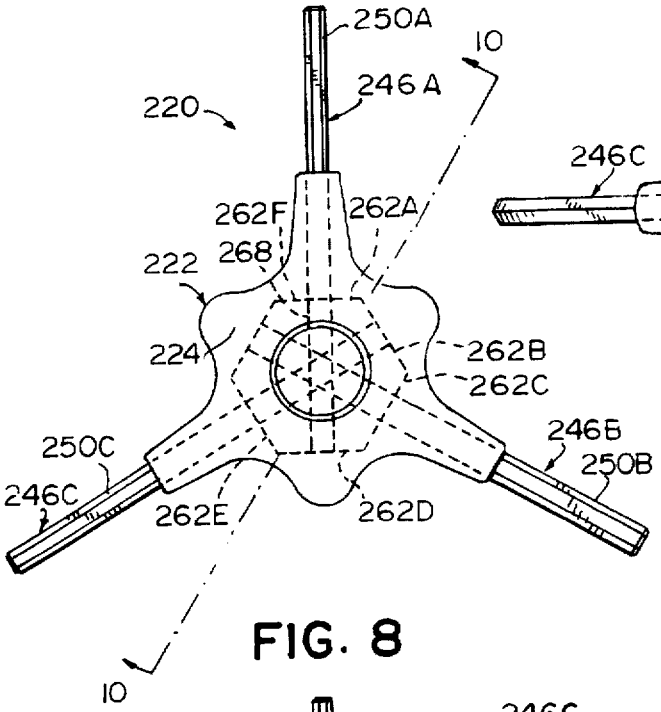
FIG. 8 is a top plan view illustrating a third tool embodiment of the present invention.
Figure 10:
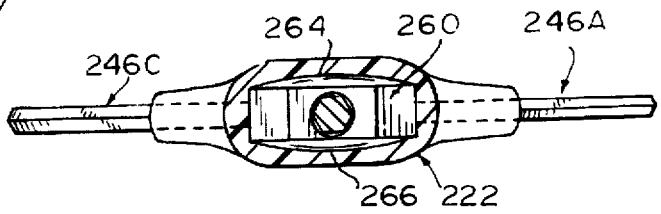
FIG. 10 is a sectional view taken generally along the line 10—10 of FIG. 8.
Figure 9:
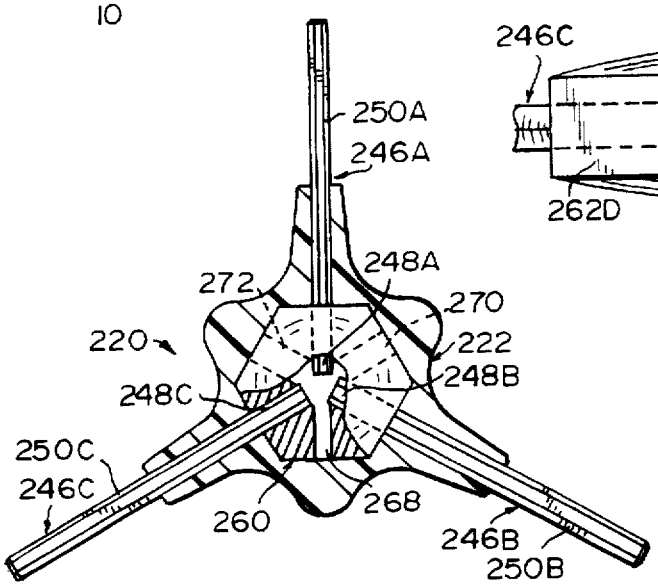
FIG. 9 is a sectional view similar to FIGS. 6 and 7 of the tool of FIG. 8.

As seen in FIGS. 8–11, an alternate embodiment of the present invention having an ergonomic handle is illustrated. Referring to FIGS. 8–10, a three-way tool 220 is provided. The tool 220 includes a handle 222 having a body 224 that is a generally triangular in shape. The handle 222 is substantially identical to the handle 22 of FIGS. 1–6, except for the interior of the body 224.

Figure 11:
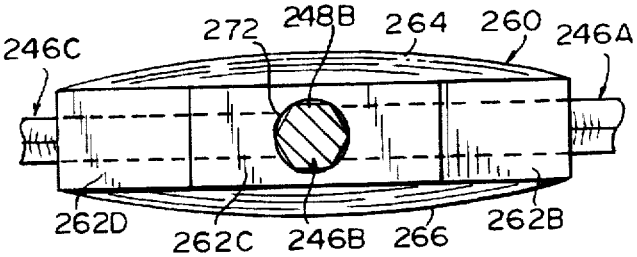
FIG. 11 is an enlarged side elevational view of the hub disposed in the interior of the handle of the tool of FIG. 10.

Disposed within the interior of the body 224 is a hexagonal hub 260 made of metal or other suitable material. The hub 260 has six sides 262A–E and opposite convex faces 264, 266 (FIGS. 10–11). The hub 260 also includes a first bore 268 running between sides 262A and 262D, a second bore 270 running between sides 262B and 262E and a third bore 272 running between sides 262C and 262F.

The tool 220 also includes three hex wrenches 246A–C respectively having straight attachment portions 248A–C respectively coaxially disposed in engagement portions 250A–C. The inner ends of the attachment portions 248A–C are respectively disposed in and press-fit, or otherwise attached to, the bores 268, 270, 272 of the hub 260. This press fitting prevents each of the hex wrenches 246A–C from rotating relative to the handle 222 when each is engaged with a hex fastener.

The handle 222 is molded around the hub 260 and a portion of the hex wrenches 246A–C after the hex Wrenches 246A–C have been respectively press fit into the bores 268, 270, 272. The bores 268, 270, 272 are, respectively, open at sides 262D, 262B and 262F because the attachment ends 248A–C do not extend through the entire length of the bores 268, 270, 272. The open ends of these bores may be plugged by known means, if necessary. This plugging and the convex shape of the faces 262, 264 may be useful in the molding process to provide (in a known manner) a handle 222 with equal wall thickness and an outer surface free of depressions or sink marks.

While particular embodiments of the prevent invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered byway of illustration only and not as a limitation. The actual scope of the invention is intended to be defined in the following claims when viewed in their proper perspective based on the prior art.

I claim:

1. A handle for tools comprising:

a generally triangular body having first, second and third vertices and first, second and third sides and adapted to fit readily in the hand of a user; and a first tubular tool holding arm for holding a first tool unit, the first tool holding arm projecting laterally outwardly from the first side and spaced from adjacent vertices and having a first lateral distal end and a first exterior surface wherein the first exterior surface and the first side respectively form a pair of continuously curved finger surfaces, each disposed between the first lateral distal end and one of the adjacent vertices.

2. The handle of claim 1, and further comprising a second tool holding arm for holding a second tool unit, the second tool holding arm projecting laterally outwardly from the second side and spaced from adjacent vertices.

3. The handle of claim 2, and further comprising a third tool holding arm for holding a third tool unit, the third tool holding arm projecting laterally outwardly from the third side and spaced from adjacent vertices, wherein the first, second and third sides have substantially the same length and the first, second and third tool holding arms are spaced about 120 degrees apart, wherein the second and third tool holding arms respectively have second and third lateral distal ends and second and third exterior surfaces, the second exterior surface and the second side respectively form a pair of continuously curved finger surfaces disposed between the second lateral distal end and one of the adjacent vertices and the third exterior surface and the third side respectively form a pair of continuously curved finger surfaces disposed between the third lateral distal end and one of the adjacent vertices.

4. The handle of claim 1, wherein the body includes first and second faces, each face connecting the first, second and third sides, wherein the first and second faces are each convex adjacent to the first, second and third sides.

5. The handle of claim 4, wherein the first and second faces are substantially mirror images of each other.

6. The handle of claim 4, wherein the first, second and third tool holding arms have frustoconical-shaped outer surfaces.

7. The handle of claim 4, wherein the body and the first, second, and third tool holding arms are a one-piece molded construction.

8. A manual tool comprising:

a generally triangular handle having first, second and third vertices and first, second and third sides and adapted to fit readily in the hand of a user, and a tubular first tool holding arm projecting laterally outwardly from the first side and spaced from adjacent vertices and having a first lateral distal end and a first exterior surface wherein the first exterior surface and the first side respectively form a pair of continuously curved finger surfaces each disposed between the first lateral distal end and one of the adjacent vertices and a first tool unit having a first attachment portion extending within the first tool holding arm and a first engaging portion disposed outside the first tool holding arm.

9. The tool of claim 8, wherein the handle further comprises a tubular second tool holding arm projecting laterally outwardly from the second side and spaced from adjacent vertices, and further comprising a second tool unit having a second attachment portion extending within the second tool holding arm and a second engaging portion disposed outside the second tool holding arm.

10. The tool of claim 9, wherein the handle further comprises a third tool holding arm projecting laterally outwardly from the third side and spaced from adjacent vertices, wherein the first, second and third sides have substantially the same length and the first, second and third tool holding arms are spaced about 120 degrees apart, and further comprising a third tool unit having a third attachment portion extending within the third tool holding arm and a third engaging portion disposed outside the third tool holding arm, wherein the second and third tool holding arms respectively have second and third lateral distal ends and second and third exterior surfaces, the second exterior surface and the second side respectively form a pair of continuously curved finger surfaces each disposed between the lateral distal end and one of the adjacent vertices, and the third exterior surface and the third side respectively form a pair of continuously curved finger surfaces each disposed between the lateral distal end and one of the adjacent vertices.

11. The tool of claim 8, wherein the handle includes first and second faces, each face connecting the first, second and third sides, wherein the first and second faces are each convex adjacent to the first, second and third sides.

12. The tool of claim 11, wherein the first and second faces are substantially mirror images of one another.

13. The tool of claim 10, wherein at least a portion of the handle is of a plastic molded construction.

14. The tool of claim 13, wherein the handle is a one-piece molded construction and the first, second and third tool arms holding are respectively,molded about the first, second and third attachment portions.

15. The tool of the claim 14, wherein the first, second and third attachment portions are L-shaped.

16. The tool of claim 13, wherein the handle further includes a hub disposed between the first and second faces and the first, second and third sides, the hub including first, second and third bores respectively aligned with the first, second and third tool holding arms, wherein a portion of the first, second and third attachment portions are respectively held within the first, second and third bores.

17. The tool of claim 16, wherein the hub is six-sided and has first and second opposite convex hub faces connecting the six sides.

* * * * *